US010969094B2

(12) United States Patent
Jiang

(10) Patent No.: US 10,969,094 B2
(45) Date of Patent: Apr. 6, 2021

(54) HEAT DISSIPATION SYSTEM, STAGE LIGHT CAP BODY AND WATERPROOF STAGE LIGHT

(71) Applicant: GUANGZHOU HAOYANG ELECTRONIC CO., LTD., Guangdong (CN)

(72) Inventor: Weikai Jiang, Guangdong (CN)

(73) Assignee: GUANGZHOU HAOYANG ELECTRONIC CO., LTD., Guangzhou (CN)

( * ) Notice: Subject to any disclaimer, the term of this patent is extended or adjusted under 35 U.S.C. 154(b) by 118 days.

(21) Appl. No.: 16/335,360

(22) PCT Filed: Aug. 11, 2017

(86) PCT No.: PCT/CN2017/097058
§ 371 (c)(1),
(2) Date: Mar. 21, 2019

(87) PCT Pub. No.: WO2018/068571
PCT Pub. Date: Apr. 19, 2018

(65) Prior Publication Data

US 2019/0301720 A1 Oct. 3, 2019

(30) Foreign Application Priority Data

Oct. 10, 2016 (CN) ..... 201610883329.6

(51) Int. Cl.
*F21V 29/02* (2006.01)
*F21V 29/76* (2015.01)
(Continued)

(52) U.S. Cl.
CPC ..... *F21V 29/76* (2015.01); *F21S 8/00* (2013.01); *F21V 29/00* (2013.01); *F21V 29/503* (2015.01);
(Continued)

(58) Field of Classification Search
CPC ..... F21V 29/76; F21V 29/83; F21V 29/763; F21W 2131/406
See application file for complete search history.

(56) References Cited

U.S. PATENT DOCUMENTS 7,414,841 B2 * 8/2008 Chen ..... G06F 1/20 165/104.33
2011/0019409 A1 * 1/2011 Wronski ..... F21V 29/74 362/235
(Continued)

FOREIGN PATENT DOCUMENTS

CN 103225789 A 7/2013
CN 203336551 U 12/2013
(Continued)

OTHER PUBLICATIONS

International Search Report Issued in Patent Application No. PCT/CN2017/097058 dated Nov. 13, 2017.
(Continued)

*Primary Examiner* — Andrew J Coughlin
(74) *Attorney, Agent, or Firm* — Pearne & Gordon LLP

(57) ABSTRACT

The invention relates to the technical field of stage lights, and in particular to a novel heat dissipation system, a stage light cap body and a waterproof stage light. The present invention discloses a heat dissipation system comprising a heat transfer substrate and a heat dispassion assembly positioned on one side of the heat transfer substrate, a first through hole being arranged on the heat transfer substrate and a displaceable unit used to open and close the first through hole being arranged on the heat dispassion assembly at a position corresponding to the first through hole. The heat dispassion system is simple in structure and convenient to use, and the light source assembly can be taken out for replacement or maintenance without completely removing
(Continued)

the heat dispassion system and components alike on the bottom of the stage light cap body.

14 Claims, 4 Drawing Sheets

(51) Int. Cl.

| | |
|---|---|
| ***F21V 29/67*** | (2015.01) |
| ***F21V 29/71*** | (2015.01) |
| ***F21V 29/00*** | (2015.01) |
| ***F21S 8/00*** | (2006.01) |
| ***F21V 29/503*** | (2015.01) |
| ***F21V 29/83*** | (2015.01) |

(52) U.S. Cl.
CPC ..... *F21V 29/67* (2015.01); *F21V 29/713* (2015.01); *F21V 29/83* (2015.01)

(56) References Cited

U.S. PATENT DOCUMENTS

2012/0236580 A1* 9/2012 Cheng ..... F21V 29/00 362/387
2012/0268894 A1* 10/2012 Alexander ..... F21V 29/75 361/709
2013/0215632 A1* 8/2013 Jackl ..... F21S 41/192 362/514
2013/0229799 A1* 9/2013 Lee ..... F21K 9/20 362/235
2018/0283644 A1* 10/2018 Mertens ..... F21K 9/20
2019/0049103 A1 2/2019 Jiang

FOREIGN PATENT DOCUMENTS

| | | | |
|---|---|---|---|
| CN | 204516365 | U | 7/2015 |
| CN | 105716046 | A | 6/2016 |
| CN | 105953145 | A | 9/2016 |
| CN | 206112690 | U | 4/2017 |
| CN | 206112833 | U | 4/2017 |
| WO | 2014-046357 | A1 | 3/2014 |

OTHER PUBLICATIONS

Written Opinion Issued in Patent Application No. PCT/CN2017/097058 dated Nov. 13, 2017.

* cited by examiner

HEAT DISSIPATION SYSTEM, STAGE LIGHT CAP BODY AND WATERPROOF STAGE LIGHT

CROSS REFERENCE TO RELATED APPLICATIONS

The present application is a continuation of International Application No. PCT/CN2017/097058, filed on Aug. 11, 2017, which claims priority from Chinese Patent Application No. 201610883329.6 filed on Oct. 10, 2016, all of which are hereby incorporated herein by reference.

TECHNICAL FIELD

The invention relates to the technical field of stage lights, and in particular to a novel heat dissipation system, a stage light cap body and a waterproof stage light.

BACKGROUND OF THE INVENTION

As for existing stage lights, a light source assembly is installed inside a light cap body, so that when the light source assembly needs to be replaced or maintained, the light source assembly can be taken out only after a heat-dissipation system and components alike on the bottom of the light cap body are completely removed, which is extremely inconvenient. Alternatively, a service port is further arranged on a housing of the light cap body at a position corresponding to the light source assembly. However, the arrangement of a service port will increase difficulty in sealing of a waterproof stage light, which needs to take waterproof effect as well as heat-dissipation effect into consideration. As a result, the object of heat dissipation is usually achieved by abandoning waterproof effect, such stage light is thus with poor waterproof effect or even without waterproof effect. Accordingly, the stage light is limited to indoor use and cannot be used outdoors in most cases, which have the drawbacks of failing to combine various functions of waterproofing, good heat-dissipation effect and convenience to disassemble and assemble and maintain the light source assembly.

SUMMARY OF THE INVENTION

The present invention provides a novel heat dissipation system, a stage light cap body therewith and a waterproof stage light to overcome at least one of the above-mentioned drawbacks in the prior art, which is simple in structure, convenient to use and the light source assembly can be taken out for replacement and maintenance without completely remove of the heat dissipation system and components alike on the bottom of the stage light cap body.

One aspect of the present invention provides a novel heat dissipation system comprising a heat transfer substrate and a heat dissipation assembly positioned on one side of the heat transfer substrate, wherein a first through hole is arranged on the heat transfer substrate and a displaceable unit used to open and close the first through hole is arranged on the heat dissipation assembly at a position corresponding to the first through hole. When the heat dissipation system is mounted on the bottom of a stage light cap body, the first through hole can be opened by moving the displaceable unit on the heat dissipation assembly. The heat dissipation assembly inside the stage light cap body can thus be taken out for maintenance or replacement through the first through hole.

Preferably, the novel heat dissipation system further comprises a heat absorbing assembly arranged on the other side of the heat transfer substrate, that is, the heat absorbing assembly and the heat dissipation assembly are respectively arranged on two sides of the heat transfer substrate. A mounting position penetrating the heat absorbing assembly is arranged on the heat absorbing assembly at a position corresponding to the first through hole and is connected with the first through hole. The mounting position is used to mount the light source assembly of the stage light, and the heat absorbing assembly encircles the light source assembly and closely contacts the light source assembly, which is convenient for the heat absorbing assembly to quickly absorb heat generated by the light source assembly.

Further, the heat absorbing assembly includes heat absorbing fins and first heat transfer tubes, wherein each of the heat absorbing fins is parallelly arranged, and a gap is defined between adjacent heat absorbing fins to form an air channel for air circulation. One end of each of the first heat transfer tubes is arranged through the heat absorbing fins, and the other end is abutted against the heat transfer substrate. The heat absorbing assembly absorbs the heat generated by the light source assembly and the heat is quickly transferred to the heat transfer substrate by the first heat transfer tubes, and then is further transferred to the heat dissipation assembly on the other side by the heat transfer substrate.

According to the present invention, the displaceable unit on the heat dissipation assembly can be in different forms, one form of which is that a second through hole is arranged on the heat dissipation assembly at a position corresponding to the first through hole, the displaceable unit is an extraction block arranged inside the second through hole and dismountable connected with the heat transfer substrate on an edge of the first through hole, and a first waterproof sealing ring is arranged between the extraction block and the heat transfer substrate. When the light source assembly needs to be taken out for replacement or maintenance, only the extraction block needs to be removed from the heat transfer substrate and taken out of the second through hole, and the light source assembly inside the stage light cap body can be taken out through the first through hole and the second through hole, which is extremely convenient without remove of the entire heat dissipation system, and is feasible to apply to a waterproof stage light since a waterproof sealing ring is provided between the extraction block and the heat transfer substrate.

Further, the extraction block includes a baseplate and heat dissipation fins arranged on the baseplate, wherein each of the heat dissipation fins is parallelly arranged, and a gap is defined between each one of those adjacent heat dissipation fins to form the air channel for air circulation. And the extraction block acts as a part of the heat dissipation assembly. Such a structure can make the heat transferred from the heat transfer substrate dissipated quickly.

In the present invention, another form of the displaceable unit is that the displaceable unit comprises of a first movable block and a second movable block, which are both in movable sealed connection with the heat transfer substrate, cover the first through hole, and can be moved toward two opposite sides to expose the first through hole. In this form, when the light source assembly of the stage light needs to be taken out for replacement or maintenance, only the first movable block and the second movable block needs to be moved toward two sides to expose the first through hole, and the light source assembly then can be taken out through the first through hole. Since the first movable block and the second movable block are in movable sealed connection with the heat transfer substrate, this form can also be applied to a waterproof stage light.

Further, the heat dissipation assembly includes heat dissipation fins, heat transfer tubes and a heat dissipation fan, wherein each of the heat dissipation fins is parallelly arranged, a gap is defined between each one of those adjacent heat dissipation fins to form an air channel for air circulation, and the heat dissipation fan is arranged at an air outlet of the air channel. Preferably, the extending direction of the air channel of the heat dissipation assembly intersects the extending direction of the air channel of the heat absorbing assembly to better disperse the heat generated by the light source assembly. One end of each of the second heat transfer tubes is arranged through the heat dissipation fins, and the other end is abutted against the heat transfer substrate. Since the heat dissipation assembly is generally arranged outside a main housing and has a corresponding air channel for air circulation, the heat transferred from the light source assembly inside the main housing can directly heat-exchange with an external space, which can achieve desired heat dissipation effect.

Another aspect of the invention provides a stage light cap body with the above-mentioned heat dissipation system, comprising a light source assembly, a heat dissipation system, and a main housing, wherein the heat transfer substrate of the heat dissipation system is in sealed connection with the end of the main housing, the heat dissipation assembly of the heat dissipation system is arranged outside of the main housing, and the light source assembly is positioned inside the main housing at a position corresponding to the first through hole on the heat transfer substrate. Such an arrangement causes heat generated by the light source assembly to be directly absorbed by the heat absorbing assembly of the heat dissipation system that is placed inside the main housing, then the heat dissipation system directly heat-exchanges the absorbed heat to the heat dissipation assembly on the other end thereof, and then the heat dissipation assembly discharges the heat-exchanged heat outside of the light. The heat generated by the light source part during operation can thus be well discharged in time.

Further, a protective shell provided with a heat dissipation opening corresponding to the heat dissipation fan is arranged on the outer periphery of the heat dissipation assembly. The arrangement of the protective shell can protect the heat dissipation assembly well and will not hinder the heat dissipation for the heat dissipation assembly with the configuration of the heat dissipation opening. An outer side of the main housing is provided with sheet-like protrusions distributed along the circumferential direction of the main housing. The configuration of the sheet-like protrusions can effectively diffuse heat conducted from the inside of the light to the main housing into external air to accelerate the dispersion and flow of a thermal airflow so as to achieve highly efficient heat dissipation.

Further aspect of the invention provides a stage light with the above-mentioned stage light cap body, comprising a light cap body, a U-shaped support frame and a base, wherein the light cap body is rotatably connected to the U-shaped support frame, and the U-shaped support frame is rotatably connected to the base.

Compared with the prior art, some beneficial effects of the present invention can be obtained.

According to the novel heat dissipation system, the stage light cap body and the waterproof stage light, the first through hole is arranged on the heat transfer substrate of the heat dissipation system and the displaceable unit is arranged on the heat dissipation assembly at a position corresponding to the first through hole, thus after the heat dissipation system is mounted on the bottom of the stage light cap body, when the light source assembly inside the stage light cap body needs to be taken out for replacement and maintenance, only the displaceable unit needs to be moved to expose the first through hole, the light source assembly can be taken out through the first through hole, which is extremely convenient. In addition, the heat dissipation system can be in sealed connection with the housing of the stage light cap body and the displaceable unit and the heat dissipation system can also be in sealed connection. Compared to conventional stage lights, such configuration can fully satisfy the requirements for stage lights to be used outdoors and in a raining environment etc. and change the usage limitation of existing stage lights, as the sealing property of the light is extremely improved. Therefore, the heat dissipation system of the present invention can be used not only for a general stage light, but also for a waterproof stage light. Meanwhile, the heat dissipation system can ensure a highly efficient heat dissipation effect for a stage light and has the advantage of combining various functions.

DESCRIPTION OF EMBODIMENTS

Figure 1:
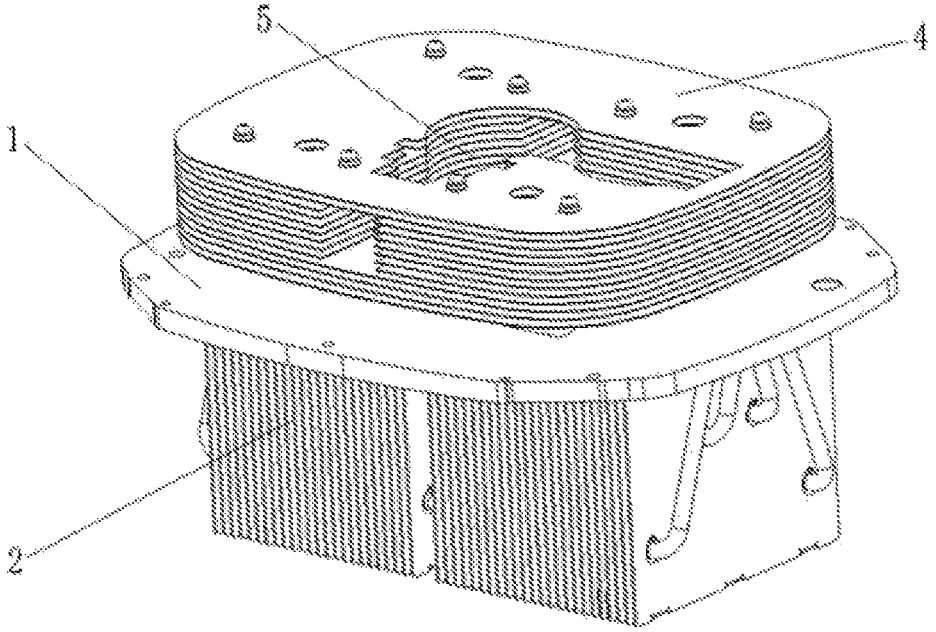
FIG. 1 is a schematic structural view of a heat dissipation system according to embodiment 1.

The drawings are for illustration purpose only and are not intended to limit the present invention. Some components in the drawings are omitted, enlarged or reduced for better illustrating the embodiments, and sizes of these components do not represent sizes of actual products. For those skilled in the art, it will be understood that some known structures in the drawings and descriptions thereof are omitted. The positional relationships described in the drawings are for illustration purpose only and are not intended to limit the present invention.

Embodiment 1

Figure 2:
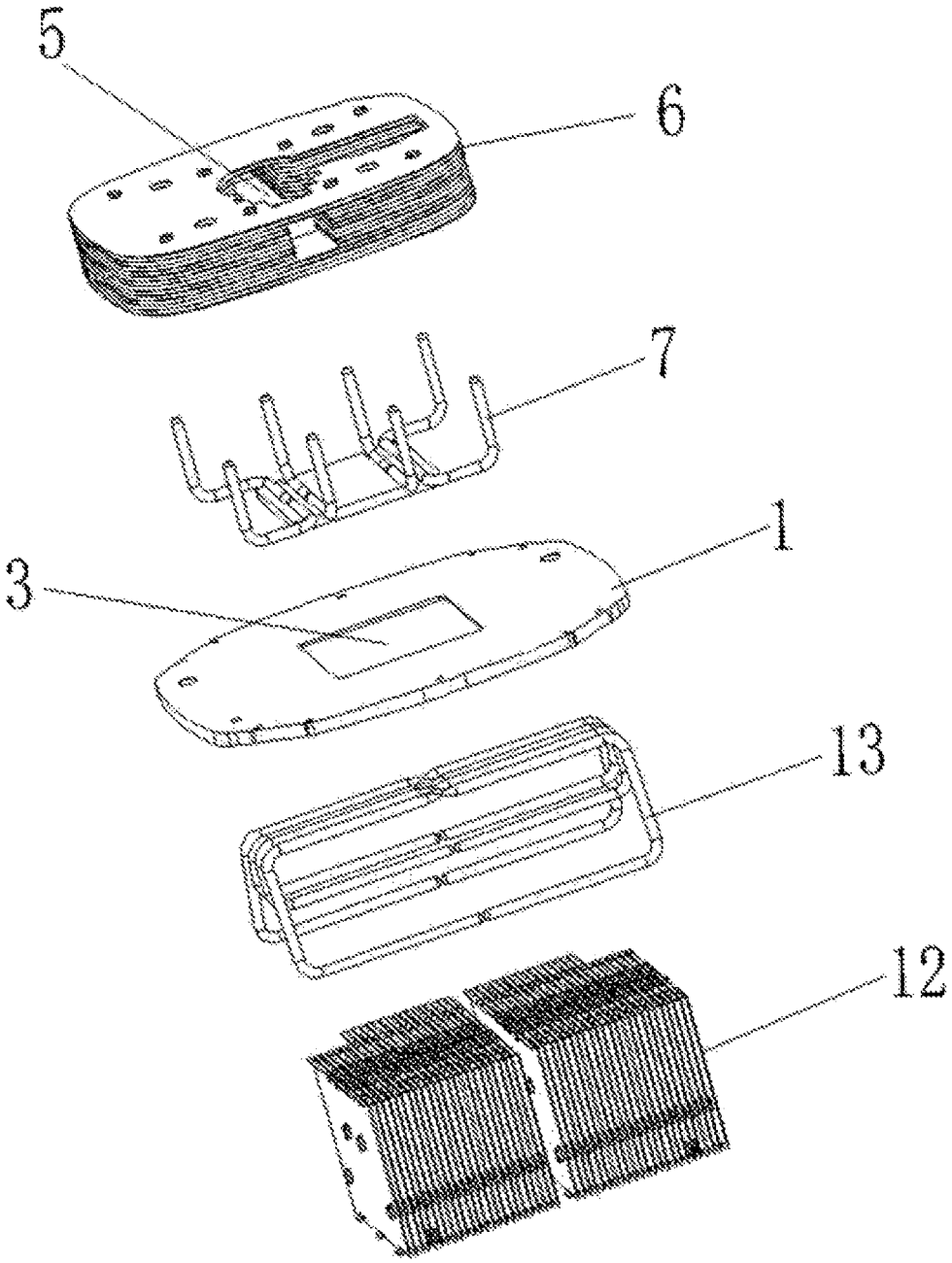
FIG. 2 is a schematic exploded view of a heat dissipation system according to embodiment 1.

As shown in FIG. 1 and FIG. 2, a novel heat dissipation system according to the present embodiment comprises a heat transfer substrate 1, a heat dissipation assembly 2 and a heat absorbing assembly 4, wherein the heat dissipation assembly 2 is positioned on one side of the heat transfer substrate 1, the heat absorbing assembly 4 is positioned on the other side of the heat transfer substrate 1, that is, the heat absorbing assembly 4 and the heat dissipation assembly 2 are respectively positioned on two sides of the heat transfer substrate 1. It should be noted that the heat absorbing assembly 4 can be excluded, that is, the heat dissipation system only includes the heat transfer substrate 1 and the heat dissipation assembly 2, which however will lower the work efficiency of the heat dissipation system. A first through hole 3 is arranged on the heat transfer substrate 1, and a displaceable unit used to open and close the first through hole 3 is arranged on the heat dissipation assembly 2 at a position corresponding to the first through hole 3. When the heat dissipation system is mounted on the bottom of a stage light cap body, the first through hole 3 can be opened by moving the displaceable unit on the heat dissipation assembly 2. The light source assembly inside the stage light cap body can thus be taken out for maintenance or replacement through the first through hole 3.

As shown in FIG. 1 and FIG. 2, a mounting position 5 penetrating the heat absorbing assembly 4 is arranged on the heat absorbing assembly 4 at a position corresponding to the first through hole 3 and is connected with the first through hole 3. The mounting position 5 is used to mount the light source assembly of the stage light and the heat absorbing assembly 4 encircles the light source assembly and closely contacts the light source assembly, which is convenient for the heat absorbing assembly 4 to quickly absorb heat generated by the light source assembly.

As shown in FIG. 2, the heat absorbing assembly 4 includes heat absorbing fins 6 and first heat transfer tubes 7, wherein each of the heat absorbing fins 6 is arranged parallelly, and a gap is defined between each one of those adjacent heat absorbing fins 6 to form the air channel for air circulation. One end of each of the first heat transfer tubes 7 is arranged through the heat absorbing fins 6, and the other end is abutted against the heat transfer substrate 1. The heat absorbing assembly 4 absorbs the heat generated by the light source assembly, the heat is then quickly transferred to the heat transfer substrate 1 by the first heat transfer tubes 7 and is further transferred to the heat dissipation assembly 2 on the other side of the heat transfer substrate 1 by the heat transfer substrate 1.

Figure 3:
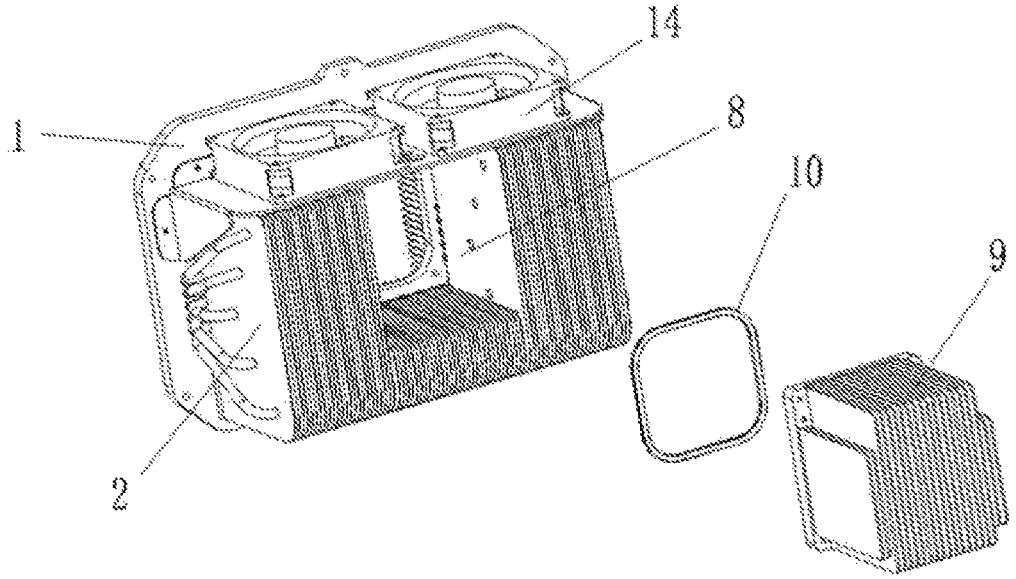
FIG. 3 is another schematic structural view of a heat dissipation system according to embodiment 1.

As shown in FIG. 3, a second through hole 8 is arranged on the heat dissipation assembly 2 at a position corresponding to the first through hole 3, the displaceable unit is an extraction block 9 arranged inside the second through hole 8 and detachably connected with the heat transfer substrate 1 on an edge of the first through hole 3, and a first waterproof sealing ring 10 is arranged between the extraction block 9 and the heat transfer substrate 1. When the light source assembly of the stage light needs to be taken out for replacement or maintenance, only the extraction block 9 needs to be removed from the heat transfer substrate 1 and taken out from the second through hole 8, and the light source assembly inside the stage light cap body can be taken out through the first through hole 3 and the second through hole 8, which is extremely convenient without remove of the entire heat dissipation system, and is feasible to apply to a waterproof stage light since a waterproof sealing ring is further arranged between the extraction block 9 and the heat transfer substrate 1.

Figure 4:
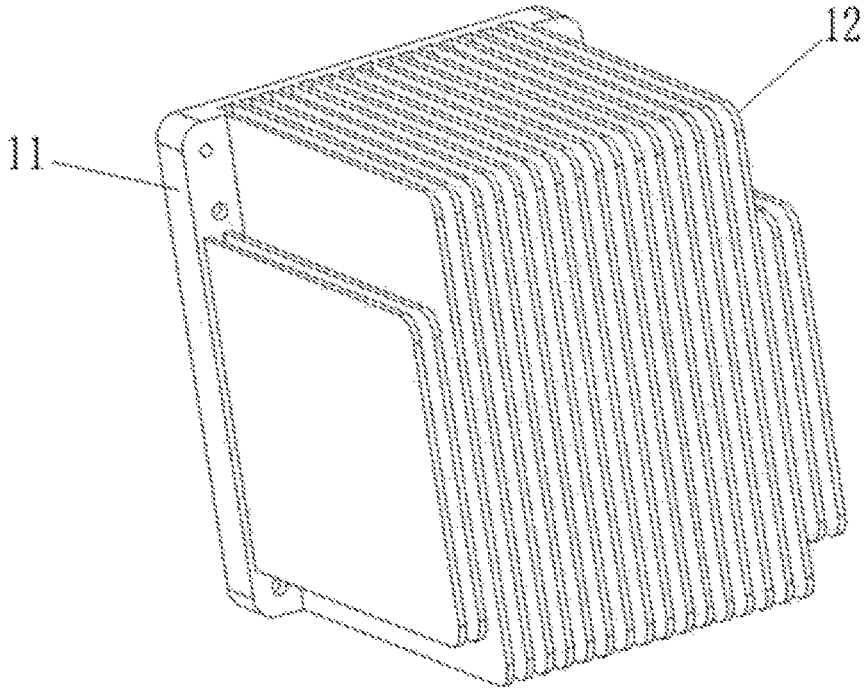
FIG. 4 is a schematic structural view of an extraction block according to embodiment 1.

As shown in FIG. 4, the extraction block 9 includes a baseplate 11 and heat dissipation fins 12 arranged on the baseplate 11, wherein each of the heat dissipation fins 12 is parallelly arranged, and a gap is defined between each one of those adjacent heat dissipation fins 12 to form an air channel for air circulation. And the extraction block 9 acts as a part of the heat dissipation assembly 2. Such a structure can make the heat transferred from the heat transfer substrate 1 dissipated quickly.

As shown in FIG. 2, the heat dissipation assembly 2 includes heat dissipation fins 12, second heat transfer tubes 13 and a heat dissipation fan 14, wherein each of the heat dissipation fins 12 is parallelly arranged, a gap is defined between each one of those adjacent heat dissipation fins 12 to form an air channel for air circulation, and the heat dissipation fan 14 is arranged at an air outlet of the air channel. Preferably, the extending direction of the air channel of the heat dissipation assembly 2 intersects the extending direction of the air channel of the heat absorbing assembly 4 to better disperse the heat generated by the light source assembly, one end of each of the second heat transfer tubes 13 is arranged through the heat dissipation fins 12, and the other end is abutted against the heat transfer substrate 1. Since the heat dissipation assembly 2 is generally arranged outside the main housing and has a corresponding air channel for air circulation, the heat transferred from the light source assembly inside the main housing can directly heat-exchange with an external space, which can achieve desired heat dissipation effect.

Embodiment 2

This embodiment is similar to embodiment 1 with the following differences. The displaceable unit comprises of a first movable block and a second movable block arranged on the heat dissipation assembly 2, which are both in movable sealed connection with the heat transfer substrate 1 cover the first through hole 3, and can be moved toward two opposite sides to expose the first through hole 3. In this configuration, when the light source assembly of the stage light needs to be taken out for replacement or maintenance, only the first movable block and the second movable block needs to be moved toward two sides to expose the first through hole 3 and the light source assembly can then be taken out through the first through hole 3. Since the first movable block and the second movable block are in movable sealed connection with the heat transfer substrate 1, this configuration can also be applied to a waterproof stage light. Notably, the operation principle of the other portions of this embodiment is the same as that of the embodiment 1.

Embodiment 3

Figure 5:
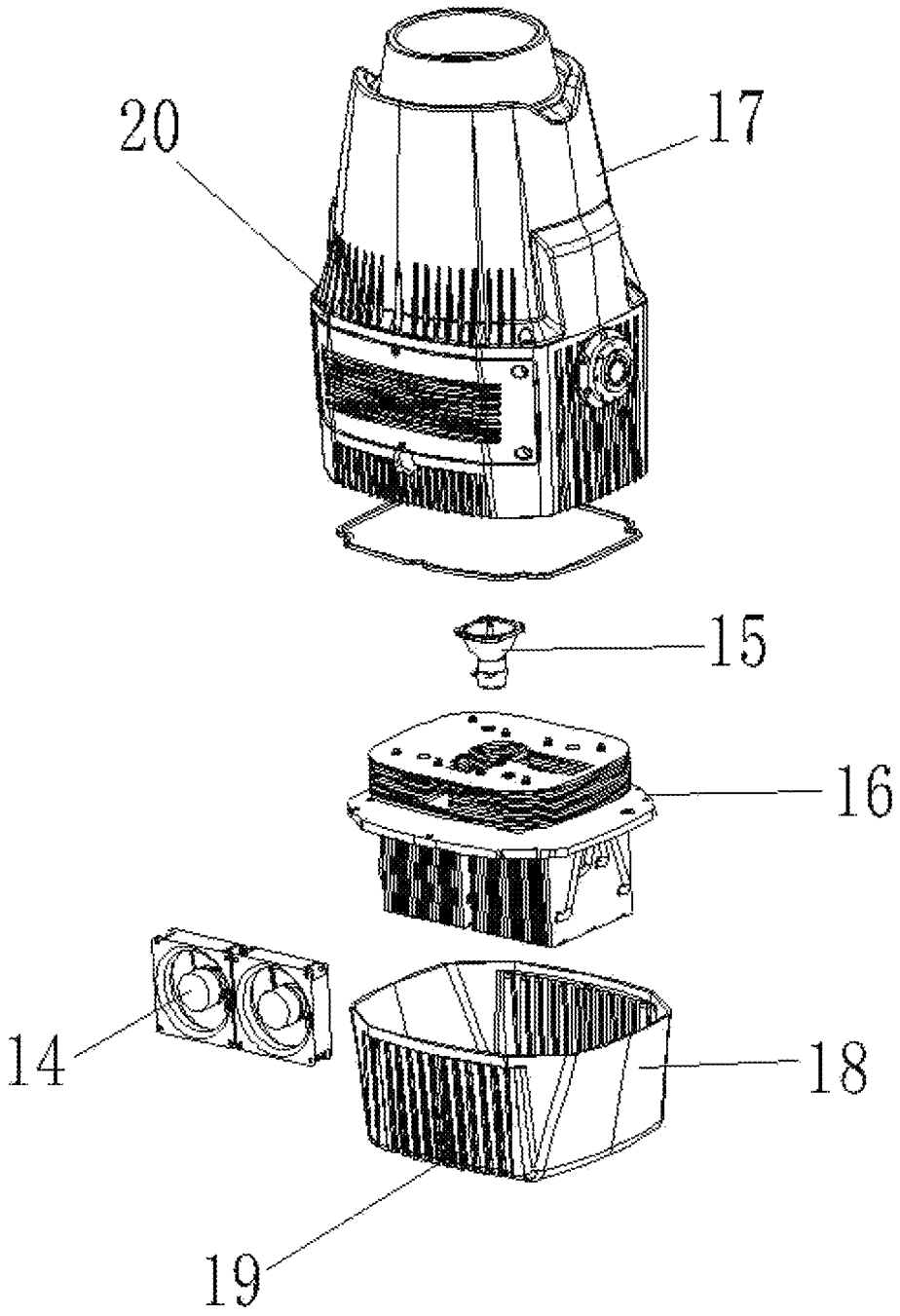
FIG. 5 is a schematic exploded view of a stage light cap body according to embodiment 3.

As shown in FIG. 5, a stage light cap body with the heat dissipation system according to 1 comprises a light source assembly 15, a heat dissipation system 16 and a main housing 17, wherein a heat transfer substrate 1 of the heat dissipation system 16 is in sealed connection with the end of the main housing 17, a heat dissipation assembly 2 of the heat dissipation system 16 is arranged outside of the main housing, and the light source assembly 15 is positioned inside the main housing 17 at a position corresponding to a first through hole 3 on the heat transfer substrate 1. Such an arrangement makes heat generated by the light source assembly 15 to be directly absorbed by the heat absorbing assembly 4 of the heat dissipation system 16 that is placed inside the main housing 17, then the heat dissipation system 16 directly heat-exchanges the absorbed heat to the heat dissipation assembly 2 on the other end thereof, and then the heat dissipation assembly 2 discharges the heat-exchanged heat outside of the light. The heat generated by the light source part during operation can thus be well discharged in time.

As shown in FIG. 5, a protective shell 18 provided with a heat dissipation opening 19 corresponding to the heat dissipation fan 14 is arranged on the outer periphery of the heat dissipation assembly 2. The arrangement of the protective shell 18 can well protect the heat dissipation assembly 2 and will not hinder the heat dissipation for the heat dissipation assembly 2 with the configuration of the heat dissipation opening 19. An outer side of the main housing 17 is provided with sheet-like protrusions 20 distributed along the circumferential direction of the main housing 17. The configuration of the sheet-like protrusions 20 can effectively diffuse heat conducted from the inside of the light to the main housing 17 into external air to accelerate the dispersion and flow of a thermal airflow so as to achieve high efficient heat dissipation.

Embodiment 4

A waterproof stage light with the stage light cap body according to embodiment 3 comprises a light cap body, a U-shaped support frame and a base, wherein the light cap body is rotatably connected to the U-shaped support frame and the U-shaped support frame is rotatably connected to the base.

Obviously, the above embodiments of the invention are merely examples for clear illustration of the invention, and are not intended to limit the implementation of the invention. Modifications or changes in other various forms can be made by those ordinary skilled in the art on the basis of the above description. There is neither need nor exhaustion for all implementations. Any modification, equivalent substitution, improvement, or the like within the spirit and principle of the invention should be included in the scope of the claims of the invention.

What is claimed is:

1. A novel heat dissipation system, comprising:

a heat transfer substrate;

a heat dissipation assembly positioned on one side of the heat transfer substrate; and a heat absorbing assembly positioned on the other side of the heat transfer substrate, wherein a mounting position penetrating the heat absorbing assembly is arranged on the heat absorbing assembly at a position corresponding to the first through hole, and the mounting position and the first through holes are communicated, wherein the heat transfer substrate is provided with a first through hole, and a displaceable unit used to open and close the first through hole is arranged on the heat dissipation subassembly at a position corresponding to the first through hole, and wherein the heat absorbing assembly includes heat absorbing fins and first heat transfer tubes, the heat absorbing fins are parallelly arranged, a gap is defined between each one of those adjacent heat absorbing fins to form an air channel for air circulation, one end of each of the first heat transfer tubes is arranged through the heat absorbing fins, and the other end thereof is abutted against the heat transfer substrate.

2. The novel heat dissipation system according to claim 1, wherein a second through hole is arranged on the heat dissipation assembly at a position corresponding to the first through hole, the displaceable unit is an extraction block arranged inside the second through hole and is detachably connected with the heat transfer substrate on an edge of the first through hole, and a first waterproof sealing ring is arranged between the extraction block and the heat transfer substrate.

3. The novel heat dissipation system according to claim 2, wherein the extraction block includes a baseplate and heat dissipation fins arranged on the baseplate, the heat dissipation fins are parallelly arranged, and a gap is defined between each one of those adjacent heat dissipation fins to form an air channel for air circulation.

4. The novel heat dissipation system according to claim 1, wherein the displaceable unit comprises of a first movable block and a second movable block arranged on the heat dissipation assembly, the first movable block and the second movable block are both in movable sealed connection with the heat transfer substrate, cover the first through hole and can move toward two opposite sides to expose the first through hole.

5. The novel heat dissipation system according to claim 1, wherein the heat dissipation assembly includes heat dissipation fins, second heat transfer tubes and heat dissipation fans, the heat dissipation fins are parallelly arranged, a gap is defined between each one of those adjacent heat dissipation fins to form an air channel for air circulation, the heat dissipation fan is arranged at an air outlet of the air channel, one end of each of the second heat transfer tubes is arranged through the heat dissipation fins, and the other end thereof is abutted against the heat transfer substrate.

6. A stage light cap body with the heat dissipation system according to claim 1, comprising:

a light source assembly;

the heat dissipation system; and a main housing, wherein the heat transfer substrate of the heat dissipation system is in sealed connection with the end of the main housing, the heat dissipation assembly of the heat dissipation system is positioned outside of the main housing, and the light source assembly is positioned inside the main housing at a position corresponding to the first through hole on the heat transfer substrate.

7. The stage light cap body according to claim 6, further comprising a heat absorbing assembly positioned on the other side of the heat transfer substrate, wherein a mounting position penetrating the heat absorbing assembly is arranged on the heat absorbing assembly at a position corresponding to the first through hole, and the mounting position and the first through holes are communicated.

8. The stage light cap body according to claim 6, wherein the heat absorbing assembly includes heat absorbing fins and first heat transfer tubes, the heat absorbing fins are parallelly arranged, a gap is defined between each one of those adjacent heat absorbing fins to form an air channel for air circulation, one end of each of the first heat transfer tubes is arranged through the heat absorbing fins, and the other end thereof is abutted against the heat transfer substrate.

9. The stage light cap body according to claim 6, wherein a second through hole is arranged on the heat dissipation assembly at a position corresponding to the first through hole, the displaceable unit is an extraction block arranged inside the second through hole and is detachably connected with the heat transfer substrate on an edge of the first through hole, and a first waterproof sealing ring is arranged between the extraction block and the heat transfer substrate.

10. The stage light cap body according to claim 9, wherein the extraction block includes a baseplate and heat dissipation fins arranged on the baseplate, the heat dissipation fins are parallelly arranged, and a gap is defined between each one of those adjacent heat dissipation fins to form an air channel for air circulation.

11. The stage light cap body according to claim 6, wherein the displaceable unit comprises of a first movable block and a second movable block arranged on the heat dissipation assembly, the first movable block and the second movable block are both in movable sealed connection with the heat transfer substrate, cover the first through hole and can move toward two opposite sides to expose the first through hole.

12. The stage light cap body according to claim 6, wherein the heat dissipation assembly includes heat dissipation fins, second heat transfer tubes and heat dissipation fans, the heat dissipation fins are parallelly arranged, a gap is defined between each one of those adjacent heat dissipation fins to form an air channel for air circulation, the heat dissipation fan is arranged at an air outlet of the air channel, one end of each of the second heat transfer tubes is arranged through the heat dissipation fins, and the other end thereof is abutted against the heat transfer substrate.

13. The stage light cap body according to claim 6, wherein a protective shell provided with a heat dissipation opening corresponding to the heat dissipation fan is arranged on the outer periphery of the heat dissipation assembly.

14. A waterproof stage light with the stage light cap body according to claim 6, comprising:

a light cap body;

a U-shaped support frame; and a base, wherein the light cap body is rotatably connected to the U-shaped support frame, and the U-shaped support frame is rotatably connected to the base.

* * * * *